United States Patent [19]

Ono

[11] 4,409,435

[45] Oct. 11, 1983

[54] HEARING AID SUITABLE FOR USE UNDER NOISY CIRCUMSTANCE

[75] Inventor: Hiroshi Ono, Tokyo, Japan

[73] Assignee: Gen Engineering Co., Ltd., Tokyo, Japan

[21] Appl. No.: 193,552

[22] Filed: Oct. 3, 1980

[51] Int. Cl.[3] ..... H04R 25/00

[52] U.S. Cl. ..... 381/71; 179/107 R

[58] Field of Search ..... 179/107 R, 107 FD, 1 P

[56] References Cited

U.S. PATENT DOCUMENTS

| | | | |
|---|---|---|---|
| 3,803,357 | 4/1974 | Sacks | 179/1 P |
| 4,025,723 | 5/1977 | Backledge | 179/107 R |
| 4,099,035 | 7/1978 | Yanick | 179/107 FD |

OTHER PUBLICATIONS

Scand Audiol 8: 121–126, 1979, No. 2, Programmable Hearing Aid with Multichannel Compression, S. Mangold et al.

*Primary Examiner*—George G. Stellar

*Attorney, Agent, or Firm*—Jordan and Hamburg

[57] ABSTRACT

A hearing aid in which input signals picked up through a microphone are divided to those of two or more frequency bands by means of a frequency division means, signal outputs of frequency band(s) in which noise signals are included are saturated or reduced by a compensating means such as compression or saturation amplifier, and mixed with signals of other signal of frequency band(s) which are not compensated, whereby ambient noises can be removed from voice sounds.

4 Claims, 3 Drawing Figures

HEARING AID SUITABLE FOR USE UNDER NOISY CIRCUMSTANCE

The present invention relates to a hearing aid suitable for use under noisy environment, and more particularly to a hearing aid serving to cut off or reduce the output level of frequency bands in which noisy signals are mainly included, to thereby make clear the hearing through a speaker or ear-phone of hearing aid.

Hearing aids widely used to enhance hearing ability have gained remarkable progress these days. However, most users complain of their hearing under noisy environment because noises are also amplified under such circumstance to make their hearing difficult. The auditory sense of a person who has normal hearing ability tends to select from ambient sounds a sound necessary to him, but persons hard of hearing are poor in such tendency of auditory sense. Therefore, conventional hearing aids are useless under noisy circumstance and must be often removed from users because noises are also amplified under such circumstance.

The following manners are well known to overcome the above-mentioned drawbacks of conventional hearing aids. One of them proposes the use of an automatic volume control circuit, such as the so-called AGC (automatic gain control). Even the hearing aid provided with this circuit leaves the problem unsolved that needed voice sounds can not be distinguished from noises because the output of needed voice sounds as well as that of speaker are automatically reduced when high noises are picked up by the microphone.

Another solution proposes the use of a high-pass filter through which low frequency components are removed from microphone inputs. This is based on the fact that frequencies of ambient noises under normal circumstance are mainly in the low frequency band, and hearing aids provided with the high-pass filter to cut off noises having frequencies lower than 1 kHz, for example, are put on the market. However, hearing aids of this type remove low frequency components, so that voice sounds are heard distorted, which is unpleasant to users. In addition, the changeover switch attached to these hearing aids to render the high-pass filter operative or inoperative according to the magnitude of ambient noises is troublesome to users.

The present invention is intended to eliminate the above mentioned drawbacks of conventional hearing aids.

It is, therefore, an object of the present invention to provide a hearing aid capable of distinguishing needed sounds from ambient noises.

Another object of the present invention is to provide a hearing aid in which the sound/noise ratio is enhanced to make needed sounds clear even when the hearing aid is used under noisy circumstance.

A further object of the present invention is to provide a hearing aid in which needed sounds are reproduced with no distortion through the ear-phone or speaker.

These and other objects of the present invention will be apparent from the following detailed description with reference to the accompanying drawing.

Figure 1:
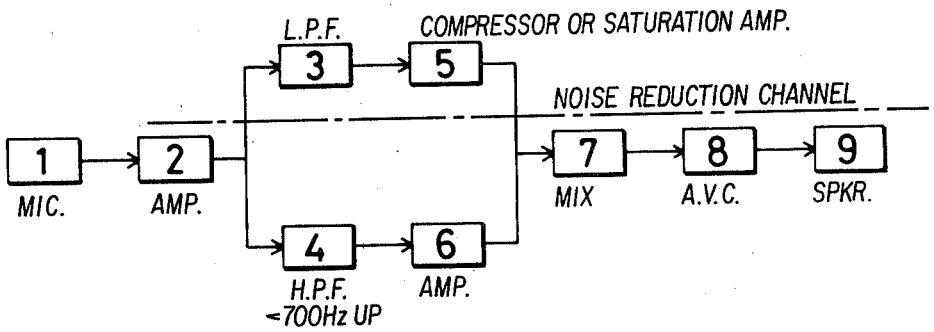
FIG. 1 is a block diagram showing an example of electrical circuit employed in the hearing aid of the present invention.

Nextly, according to FIG. 1, an embodiment of the present invention will be described. In this embodiment, input signals are divided into two signals having frequencies ranging in two different frequency bands. Input signals picked up through a microphone 1 are amplified by a pre-amplifier 2 and divided to two frequency bands by a frequency division means comprising low- and high-pass filter 3 and 4, for example. Signal outputs of low band frequency component are amplified by a compensating means 5 such as compression or saturation amplifier, by which input above a certain level are saturated or reduced, and mixed in a mixing circuit 7 with high band frequency components amplified by a normal amplifier 6, and adjusted in volume by an automatic volume control 8 to be fed as outputs to an earphone 9.

The high-pass filter 4 employed in the above-mentioned circuit may have a cut-off frequency of 500 Hz, 18 dB/oct slope, for example. It is undesirable in this embodiment to use a high-pass filter having a cut-off frequency higher than 700 Hz and 18 dB/oct slope, because reproduced sounds will become hard and make it difficult to hear.

The low-pass filter 3 may have a cut-off frequency of 1 kHz and 6 dB/oct slope, for example.

Outputs of high frequency component obtained from the high-pass filter 4 are amplified by the amplifier 6. In this embodiment, normal type amplifier 6 is used, because a hearing aid of this embodiment is made for use under a normal circumstance, in which most of frequencies of ambient noises are included in low frequency bands (obtained from the low-pass filter 3, and moreover the use of automatic volume control circuit 8 makes it unnecessary to compensate outputs of high frequency component.

On the contrary, low frequency components obtained from the low-pass filter 3 contain signals of ambient noises, this making it necessary to compensate their outputs. The compensation of outputs of low frequency component is achieved by the compensating means 5 such as a compression or saturation amplifier. The compensating amplifier 5 employed has such input and output curve characteristic that outputs are saturated or reduced when inputs reach the level of about 50–80 dB, and selected according to the hearing ability of users and the spectral characteristic of ambient noises in a circumstance under which the hearing aid is used. However, it is usual to employ the compression amplifier 5 as a compensating means which causes outputs to be saturated or reduced when the level of ambient noises exceeds about 60 dB.

Figure 2:
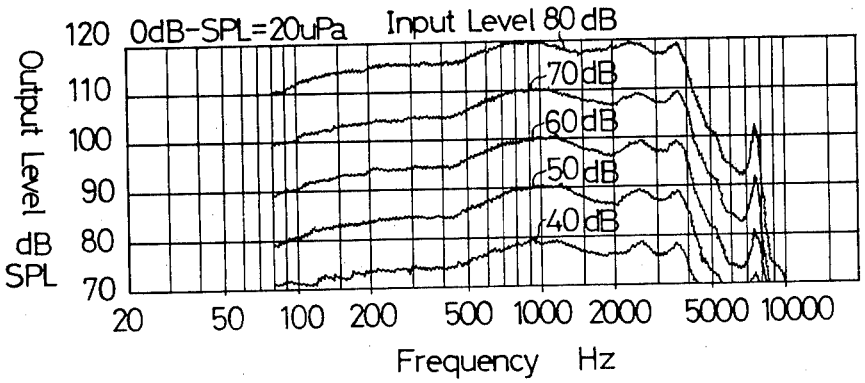
FIG. 2 is a graph showing the output characteristic of hearing aid that does not include the compensating means of this invention.

FIG. 2 shows frequency responses in the case in which the compensating means 5 is not employed. In this case low and high frequency components are together amplified corresponding to the magnitude (or dB) of ambient noises, so that speech sounds can not be distinguished from ambient noises.

Figure 3:
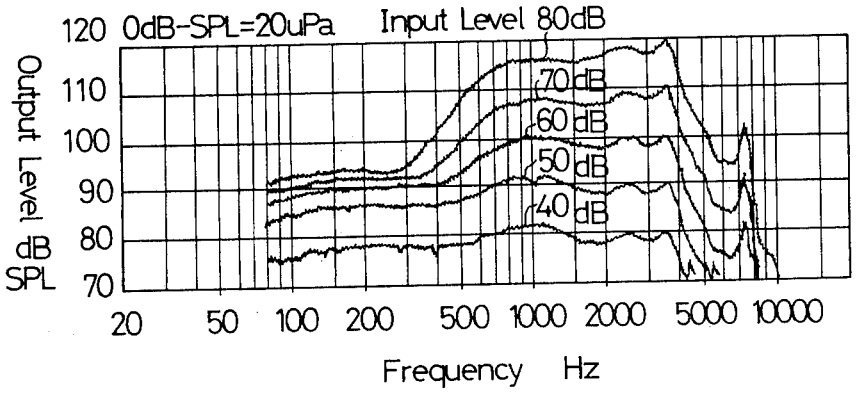
FIG. 3 is a graph showing the output characteristic of hearing aid of the present invention.

FIG. 3 shows frequency responses in the case in which the compensating means 5 is employed. When inputs of ambient noises (or low frequency component) are low, they are amplified, but when above 60 dB, for example, their amplifying degrees is saturated or reduced. Therefore, when they are compounded with outputs gained through the high-pass filter 4, outputs of high frequency component become high to thereby enhance the S/N ratio. As the result, sounds which users want to hear can be clearly caught by their ears.

According to the above-mentioned embodiment using plural filters as a frequency division means and an amplifying circuit as a compensating means in which low band frequency components including mainly noise signals are selectively compensated, voice sound signals can be automatically distinguished from noises corresponding to the level of ambient noises, and when ambient noises are low, low frequency components are not cut off, allowing input voice sounds to be kept natural (when no ambient noise is present, the amplifying circuit 5 is left inoperative keeping outputs to have flat frequency characteristic). When inputs of low band frequency component such as car noises exceed the certain level, the amplifying circuit 5 is rendered operative causing low band frequency components to be substantially attenuated and to have comprehensive frequency characteristic. Ambient noises contained in high frequency components can be easily attenuated by a means such as earphone and sound pipe arranged in the output line. But, in case most of noise signals are included in high frequency bands, and said noise signals can not be attenuated by said normal way, it is desirable to use compensating means described in the above embodiment for cutting off high frequency noises.

Moreover, one or more frequency band(s) which should be compensated by a compensating means is determined according to a place on which a hearing aid is mainly used, a frequency band of noise signal, and electric or mechanical characters of components included in a hearing aid.

What is claimed is:

1. A hearing aid suitable for use under noisy conditions comprising;

a frequency division means for dividing input signals picked up through a microphone into a first low frequency range and a second substantially unattenuated frequency range higher than said first range, said second range having a low frequency cutoff that is no higher than 700 Hz., a compensating means for selectively saturating or reducing the output level of one of said ranges including noisy signals therein only when the input level of signals of said one frequency range is higher than the certain level, and a mixing means for mixing said compensated signals of said one frequency range with non-compensated signals of the other of said frequency ranges.

2. The hearing aid of claim 1 wherein said one range is said first low frequency range.

3. The hearing aid of claim 2 wherein said frequency division means comprises a low pass filter for separating said first low frequency range and a high pass filter for separating said second higher frequency range.

4. The hearing aid of claim 3 wherein said high pass filter has a cutoff frequency no higher than 700 Hz.

* * * * *